United States Patent [19]

Matsumoto et al.

[11] 4,217,015

[45] Aug. 12, 1980

[54] CATHODE RAY TUBE AND A VENTILATOR USED IN ITS BAKING PROCESS

[75] Inventors: Shigeo Matsumoto, Inazawa; Koichi Tago; Hidetoshi Kato, both of Ichinomiya, all of Japan

[73] Assignee: Sony Corporation, Tokyo, Japan

[21] Appl. No.: 966,667

[22] Filed: Dec. 5, 1978

[30] Foreign Application Priority Data

Dec. 9, 1977 [JP] Japan ..... 52/148606

[51] Int. Cl.[2] ..... H01J 9/20; H01J 9/38

[52] U.S. Cl. ..... 316/30; 427/64

[58] Field of Search ..... 427/64, 68; 316/24, 316/30; 29/157 C

[56] References Cited

U.S. PATENT DOCUMENTS

| | | | |
|---|---|---|---|
| 2,570,165 | 10/1951 | Shekels | 427/105 X |
| 2,655,408 | 10/1953 | Williams | 29/157 C |
| 2,694,851 | 11/1954 | Marra | 29/157 C |
| 2,937,107 | 5/1960 | Phillips | 427/64 |
| 3,200,479 | 8/1965 | Peterson | 29/157 C |
| 3,819,409 | 6/1974 | Phillips | 427/69 |

*Primary Examiner*—Richard B. Lazarus

*Attorney, Agent, or Firm*—Hill, Van Santen, Steadman, Chiara & Simpson

[57] ABSTRACT

Method of manufacturing a cathode tube and for a ventilator used in its baking process which eliminates the need for a pre-baking process, and polyvinyl-alcohol (PVA) in the phosphor coating and an acrylic resin layer are completely baked and decomposed during the process of the frit-sealing furnace. A ventilator is used in its baking process. The panel portion and a funnel portion are placed in a frit-sealing furnace with a mutually coupled condition so that both portions are frit-sealed and the phosphor is baked. A bulb formed of the panel and funnel portions is provided with a ventilator means to carry out the baking operation.

3 Claims, 9 Drawing Figures

CATHODE RAY TUBE AND A VENTILATOR USED IN ITS BAKING PROCESS

BACKGROUND OF THE INVENTION

1. Field of the Invention

The present invention relates to a method of manufacturing a cathode ray tube, and particularly to a baking method used in the case of forming a phosphor coating, an acrylic resin layer and a metallization layer on the inner surface of the panel of a cathode ray tube, and then baking and decomposing polyvinyl alcohol (PVA) contained in the phosphor coating and the acrylic resin. This invention is also concerned with a ventilator used in the above baking process.

2. Description of the Prior Art

According to a prior art method of manufacturing a color cathode ray tube, at first, on the panel inner surface of the cathode ray tube there is uniformly coated phosphor slurry composed of phosphor and a photosensitive binder (including PVA). After drying the above slurry, a process of exposing and developing it in a predetermined pattern is repeated at every color to produce a color phosphor coating consisting of, for example, green, blue and red color phosphor stripes. Next, on this color phosphor coating there is coated a water emulsion of acrylic resin which serves as a priming for forming a flat metallization layer. After being dried, this acrylic resin layer is applied thereon with a metallization layer consisting of a vaporized film such as aluminum. Then, this panel portion and a funnel portion, which integrally includes a neck portion, are placed in a frit-sealing furnace with a mutually coupled condition and frit-sealed together to produce a bulb. In this process, the frit-sealing operation between panel portion and funnel portion is carried out and also organic substances in the tube such as PVA in the phosphor coating and acrylic resin are subjected to baking and decomposing operation. With the above processes, a color cathode ray tube is manufactured.

Recently, in order to increase the brightness of a cathode ray tube, there has been proposed a method of forming a phosphor coating by using phosphor having large grain size (so-called non-ballmilled phosphor), and accordingly, a new type acrylic resin layer has been required from a viewpoint of coating technique. In coating this acrylic resin layer, since the phosphor is large in grain size, it is necessary to increase the concentration of acrylic resin in water emulsion (new concentration is 34 to 40%, while the prior concentration has been 25%), and is also necessary to make the film a little thick. However, when such phosphor with large grain size is employed, it was ascertained that with the prior art manufacturing method as mentioned above, or with the processes including the formation of phosphor coating, the formation of the metallization layer, the coupling of the panel portion and the funnel portion, the frit-sealing process, and the like, the PVA and acrylic resin are not fully decomposed and hence, an object to use a new phosphor is not attained. In the prior art, the above problem has been settled by using the combination of processes that form the metallization layer, only the panel is pre-baked. Then the panel portion and funnel portion are combined to be frit-sealed, but at present they cannot be completely decomposed and removed as organic gas. This is considered to be caused by a fact that the tube passes through the furnace with the shape of a bulb having a narrow neck portion so that the inside of the bulb is not ventilated and an atmosphere necessary for baking and decomposing the phosphor surface can not be obtained.

SUMMARY OF THE INVENTION

Accordingly, it is an object of this invention to provide a method of manufacturing a cathode ray tube wherein the pre-baking process is omitted and PVA in the phosphor coating and acrylic resin layer are completely baked and decomposed during the process in the frit-sealing furnace, and also a ventilator is used in the baking process in the frit-sealing furnace.

According to one of the features of this invention, phosphor slurry is coated on the inner surface of a panel portion, and after being dried, the slurry is exposed and developed in a predetermined pattern, the above process is then repeated to form, for example, a predetermined color phosphor coating, and thereafter a metallization layer is formed on the phosphor coating through an acrylic resin layer. Next, the panel portion and a funnel portion integrally including a neck portion are placed in a frit-sealing furnace with a mutually coupled condition so that both portions are frit-sealed and the phosphor is baked. In this process, a bulb formed of the panel and funnel portions, or a cathode ray tube, is provided therein with a ventilator means, for example, a duct connected to the outside is inserted into the cathode ray tube during the baking operation.

As described above, if the cathode ray tube in the frit-sealing furnace is provided therein with a pipe which is connected to the outside, the inside of the cathode ray tube in the frit-sealing furnace is spontaneously ventilated by air flowing in the furnace and PVA in the phosphor coating and acrylic resin layer can be completely baked and decomposed without a pre-baking process. It is, of course, necessary that the frit-sealing operation of the panel portion and the funnel portion be simultaneously performed.

The other objects, features and advantages of this invention will be apparent from the following description taken in conjunction with the accompanying drawings.

DESCRIPTION OF THE PREFERRED EMBODIMENTS

A description will be given of embodiments of this invention with reference to the drawings.

Figure 1:
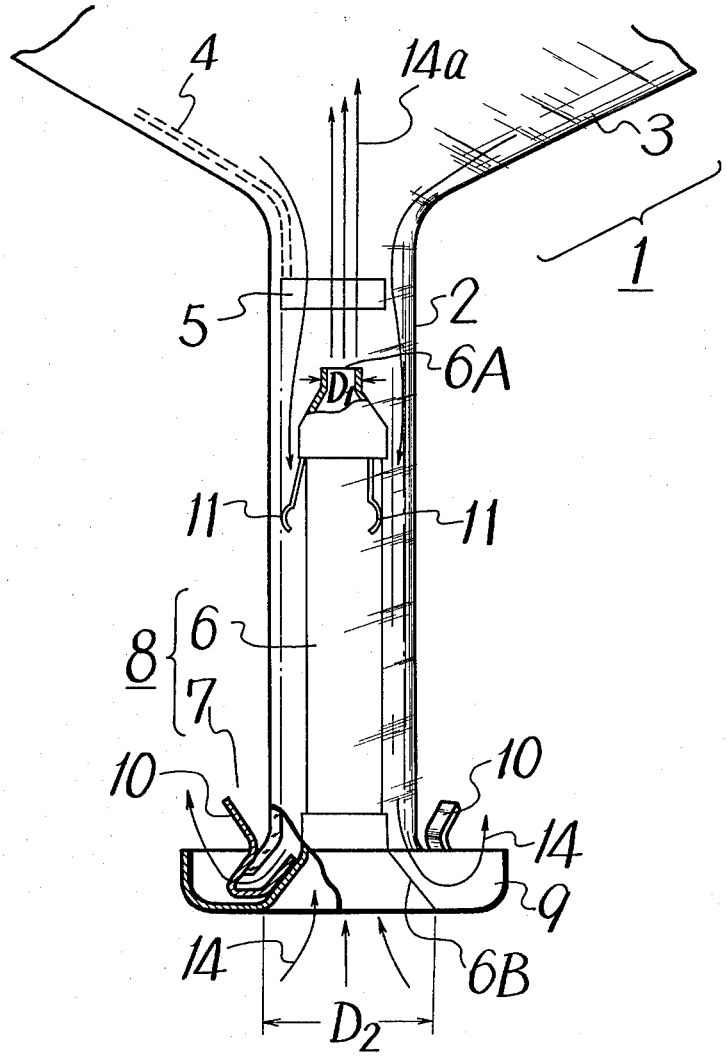
FIG. 1 is a view showing one embodiment of a cathode ray tube of this invention.
Figure 2:
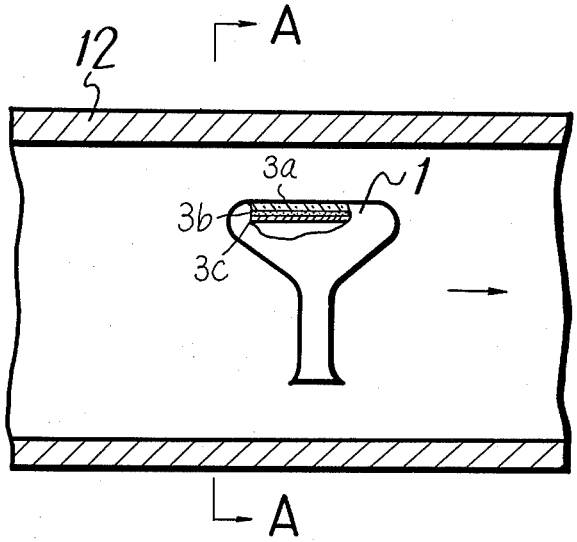
FIG. 2 is a cross-sectional view showing a frit-sealing furnace including a cathode ray tube.

FIGS. 1 and 2 show one embodiment of this invention, in which a cathode ray tube, or bulb 1 is composed of a funnel portion 3 integrally coupled to a neck portion 2 and a panel portion 3*a*. On the inner surface of the panel portion 3*a* is formed a color phosphor coating 3*b*, and on this coating a metallization layer 3*c* is formed through an acrylic resin layer, thus a phosphor surface being provided. Further, a color selection grid (not shown) is disposed in opposition to this phosphor surface. At a position in the neck portion 2 near the funnel portion 3 there is resiliently inserted a ring-shaped conductive member 5 used for supplying a convergence voltage extending from an anode button (not shown) through a cable 4, if required. This ring-shaped conductive member 5 is used to apply a convergence voltage to an electrostatic convergence means provided at the top end of an electron gun device which will be disposed in the neck portion 2.

A ventilator 8 consisting of a pipe 6 and a support member 7 for supporting the pipe 6 in the cathode ray tube 1 is disposed in the neck 2 of the cathode ray tube 1. The pipe 6 is formed in the shape of a vertically extending bar with the opening diameter $D_1$ of its upper nozzle 6A being smaller than that $D_2$ of its lower inlet 6B. The end edge portion of the lower inlet 6B is folded outward to provide a flange 9, and a holder 10 made of a metal plate spring is attached to the flange 9 so as to resiliently engage the end edge of the neck 2 to hold the pipe 6 thereto. This holder 10 is attached to the flange 9 at three places with, for example, an equal angular spacing of 120°. On the outside of the upper end of pipe 6 there are, for example, three resilient members 11 mounted with an equal angular spacing of 120° so that when the pipe 6 is inserted into the neck 2, the members 11 resiliently engage the inner wall of the neck 2 to hold the pipe 6 therein and also to center the upper nozzle 6A and to prevent it from shifting.

Figure 3:
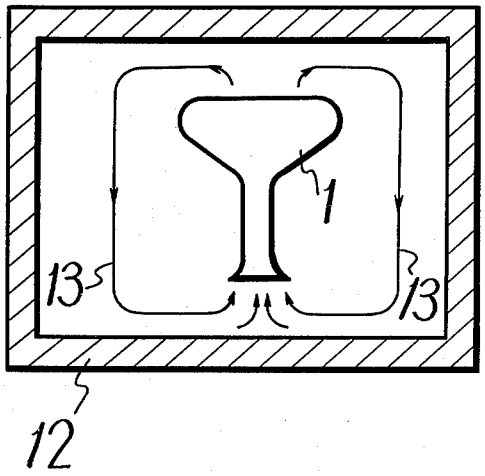
FIG. 3 is a cross-sectional view taken on line A—A of FIG. 2, and FIG. 4 through FIG. 9 are views, respectively, showing other embodiments of a cathode ray tube of this invention.

The ventilator 8 as mentioned above is inserted into the neck 2 of the cathode ray tube 1 with its upper nozzle 6A being located inside the neck 2 and its lower inlet 6B being located outside the neck 2, and firmly held in the neck 2 by the holders 10 and resilient members 11. When in the position shown in the neck 2, the pipe 6 is positioned with its upper nozzle 6A under the ring-shaped member 5. With the ventilator 8 mounted as mentioned above, the cathode ray tube 1 is placed in a frit-sealing furnace 12 as shown in FIGS. 2 and 3. In this case, air convection 13 occurs in the furnace 12 and air will flow upwardly at the center of the furnace 12 as shown in FIG. 3, in the cathode ray tube 1 disposed at the center of the furnace 12, and air 14 flows through the pipe 6 to the phosphor surface of the panel and then flows between the outside of the pipe 6 and the inner wall of the neck 2 to the outside as shown in FIG. 1, and thus the tube 1 is ventilated. In this case, air passes through the narrow pipe 6, and since the opening diameter $D_1$ of the upper nozzle 6A is smaller than the opening diameter $D_2$ of the lower inlet 6B, the upper nozzle 6A discharges an air jet stream 14*a* as shown in FIG. 1, which reaches the phosphor surface of the panel (it can be said that the air jet stream is discharged from the upper nozzle 6A to a distance about ten times the opening diameter $D_1$). Thus, ventilation of the phosphor surface is thoroughly performed and the PVA of the phosphor coating and acrylic resin layer are satisfactorily baked and decomposed.

Figure 4:
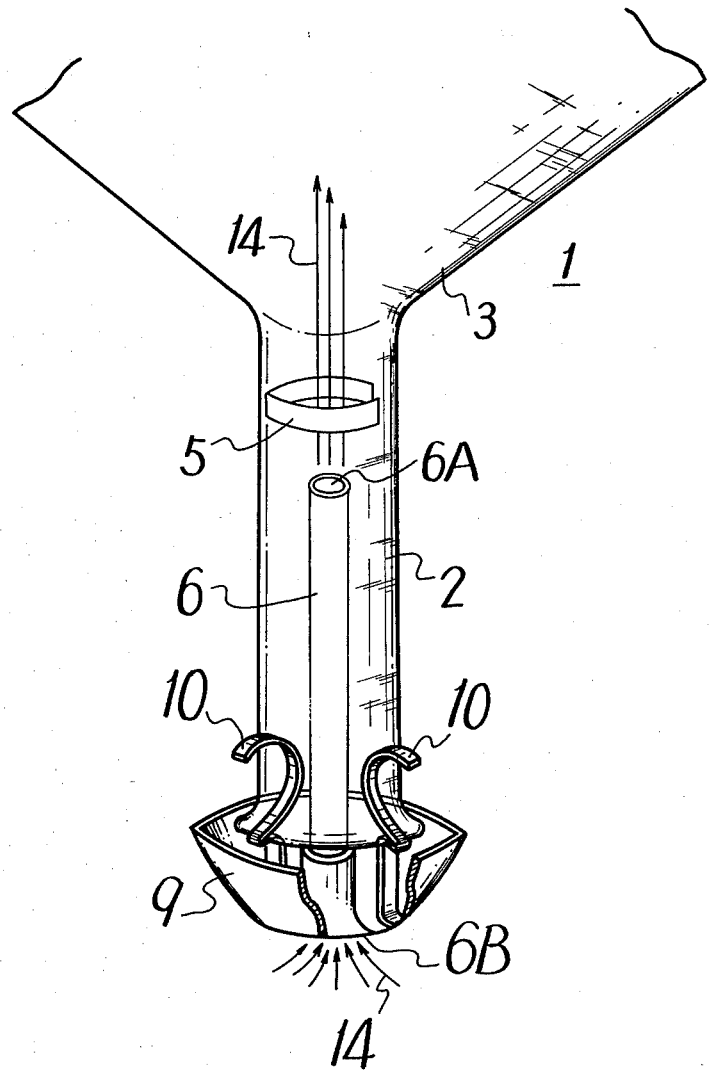

With the ventilator 8 as shown in FIG. 1, the air jet stream 14*a* is obtained due to the upper nozzle 6A of the pipe 6, so that when the ventilator is positioned in the neck 2, it becomes possible to dispose it below the ring-shaped member 5. Therefore, when inserting the ventilator 8 the ring-shaped member 5 will not be pushed up by mistake to shift its position or to break it. Further, as the holder 10 is made of metal plate spring material for holding the pipe 6 to the neck 2, it can be constructed with a shape such as to resiliently hold the end edge of the neck 2 therebetween as shown in FIG. 4.

Figure 5:
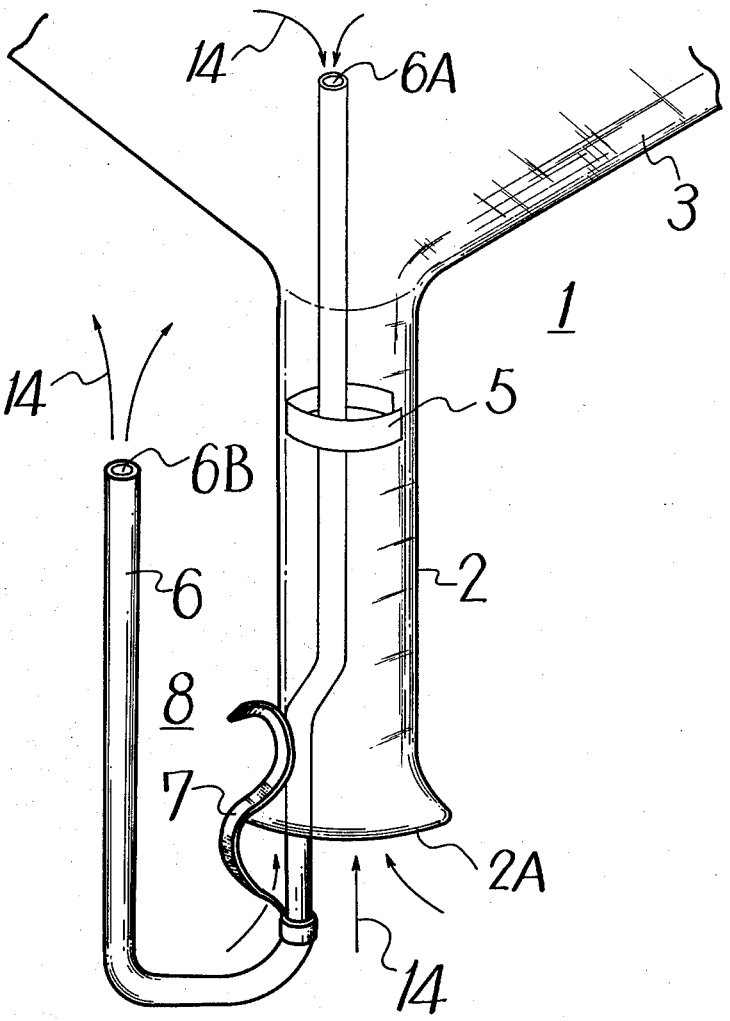

FIG. 5 shows another embodiment of this invention, particularly an embodiment of the ventilator attached in a cathode ray tube. This ventilator 8 is constructed in such a manner that the pipe 6 is formed in a substantially U-shape with one opening 6A being inserted through the neck 2 into the cathode ray tube 1 and the other opening 6B being positioned outside the cathode ray tube 1, and the bulb wall of the neck 2 is held between the support member 7 and the pipe 6 inside the cathode ray tube 1. The support member 7 is made of a metal plate spring and is attached to the intermediate portion of the pipe 6. In this case, the pipe 6 in the cathode ray tube 1 is bent so as to locate its opening 6A at the center of the cathode ray tube 1. The pipe 6 in the tube 1 is also formed to be long enough so that its opening 6A is positioned at a place nearer to the panel side than the position of the ring-shaped member 5. Moreover, the pipe 6 outside the tube 1 is formed so as to point its opening 6B upward. If the opening 6B is turned downwardly, the ventilation will not be satisfactory. If the pipe 6 extends upwardly, air in the tube 1 will be drawn out satisfactorily because the air convection currents flow upwardly.

When using the ventilator 8 as mentioned above, in the frit-sealing furnace 12 the air 14 enters the cathode ray tube 1 from the opening 2A of the neck 2 and flows through the pipe 6 to the outside of the tube 1 and exists from its opening 6B, thus providing ventilation in the cathode ray tube 1, particularly at a positions near its panel surface. In this case, since the air convection flows upwardly at the center of the furnace 12 where the cathode ray tube 1 is disposed, if the opening 6B of the pipe 6 outside the tube 1 is turned upwardly, air is drawn out from the opening 6B to properly ventilate the tube 1 and hence PVA in the phosphor coating and acrylic resin layer are fully baked and decomposed.

Figure 6:
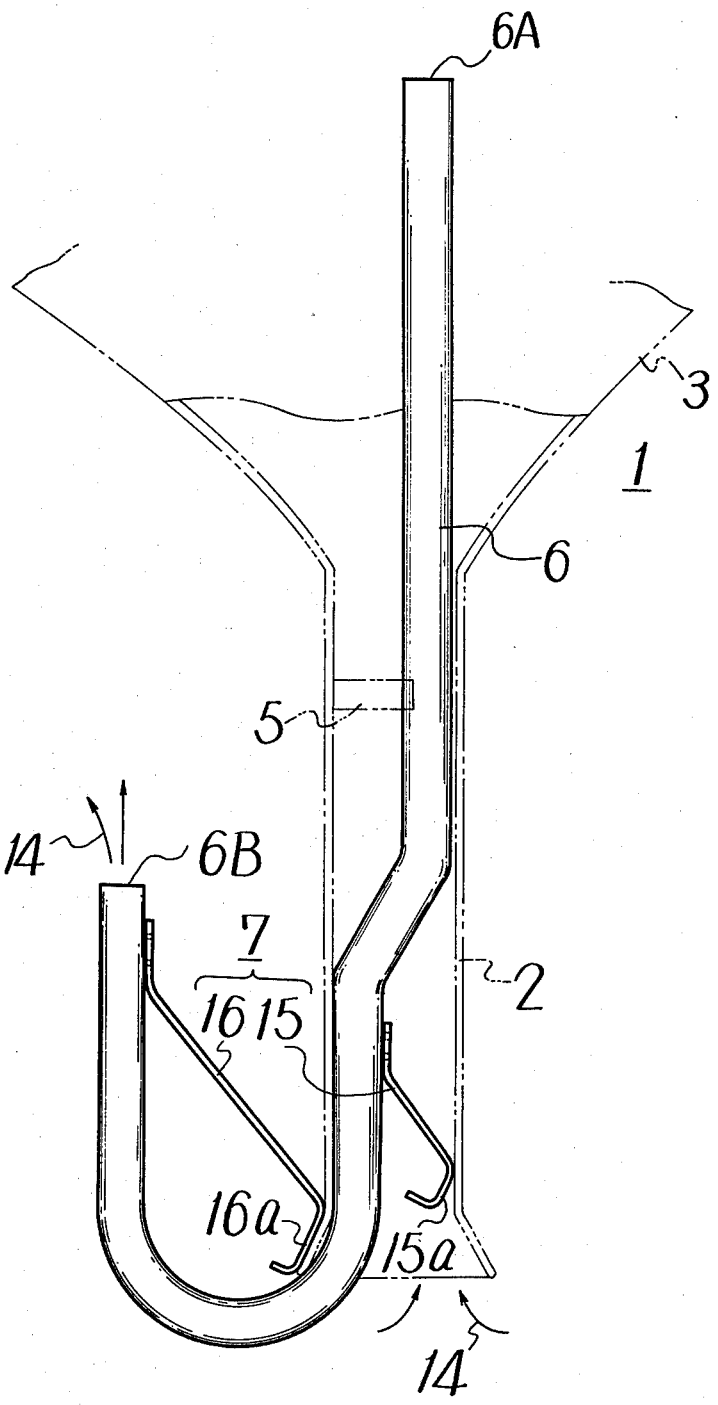
Figure 7:
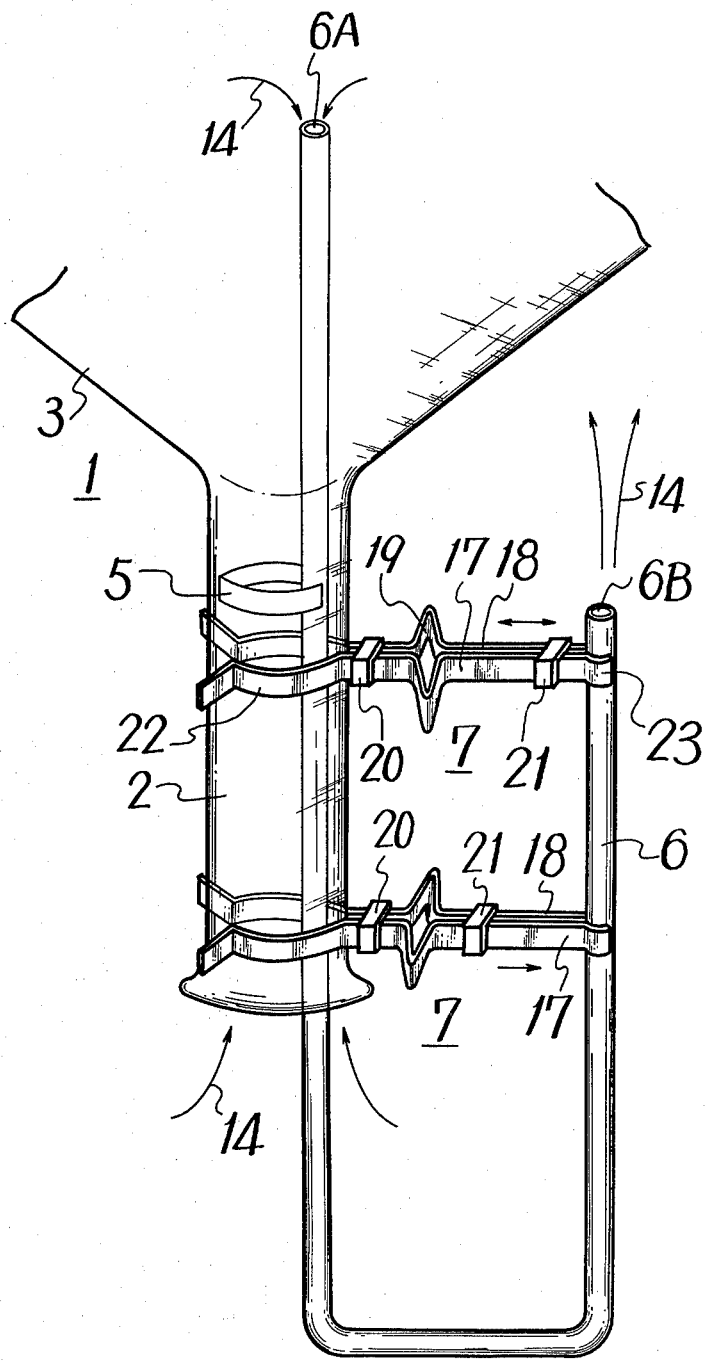

Instead of the support member 7 of the pipe 6 formed substantially in an U-shape, there can be constructed members such as shown in FIGS. 6 and 7 in addition to the example shown in FIG. 5. In the example of FIG. 6, a plate spring 15 is fixed with one end connected to one side of the pipe 6 in the neck 2 and the other end thereof is resiliently engaged with the inner wall surface of the neck 2 thereby to urge the other side of the pipe 6 against the other inner wall surface of the neck 2. In addition, a plate spring 16 is fixed to the pipe 6 outside of the neck 2 and its free end 16*a* engage the outer wall surface of the neck end so that the neck 2 is held between the plate spring 16 and the pipe 6. Thus, the pipe 6 is firmly supported.

In an example of FIG. 7, there is provided a support member 7 comprising a pair of resilient strip members 17 and 18 with the center portions thereof being bent outward, thereby to form bent portions 19, and slidable rings 20 and 21 are mounted on the strip members 17 and 18 at both sides of the bent portion 19. and supporters 22 and 23 are formed at both ends of the strip members 17 and 18 for supporting therebetween the neck 2 and the pipe 6 outside of the neck 2. In this case, two sets of support members 7 are preferably provided. With the neck 2 and the pipe 6 outside the neck being respectively inserted into the supporters 22 and 23 of the support members 7, the respective rings 20 and 21 are moved toward the supporters 22 and 23 to increase the force of the supporters 22 and 23 to fasten the neck 2 and the pipe 6, and thus the pipe 6 is supported relative to the neck 2. In this case, if the rings 20 and 21 are moved toward the bent portion 19, the fastening forces of the supporters 22 and 23 will be less and hence the position of the opening 6A of the pipe 6 can be easily adjusted.

Figure 8:
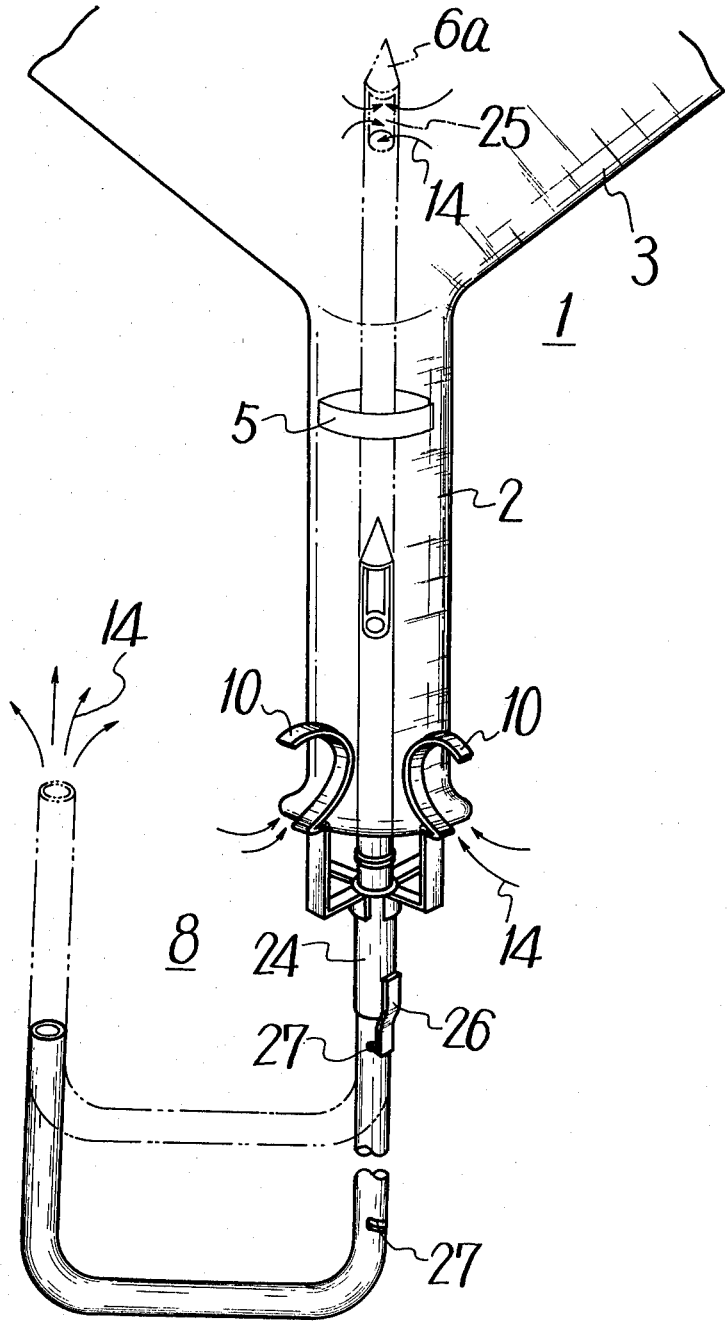

FIG. 8 shows a further embodiment of this invention. The ventilator 8 in this embodiment is composed of holders 10 each made of metal plate spring and fitted to the opening end edge of the neck 2, for example, at four places thereof. A pipe-like housing 24 supports the holders 10 which are integrally attached thereto, and a substantially U-shaped pipe 6 is inserted through the housing 24. One end **6*a* of the pipe 6 is disposed in the cathode ray tube 1 and is cone-shaped and an air vent 25 is provided immediately under the cone-shaped end 6*a*. The housing 24 is also provided with a pawl 26 for fixing the position of the pipe 6, and the pipe 6 is provided with an engageable hole 27 which is adapted to engage with the pawl 26. With this ventilator 8, the holders 10 are fitted to the opening end edge of the neck 2 to fix the housing 24, and then the pipe 6 is inserted into the housing 24 and moved axially upwardly, and then the pawl 26 is engaged with the hole 27 of the pipe 6. Thus, the ventilator 8 is housed in the cathode ray tube 1. In this case, since the top end 6*a* of the pipe 6 is cone-shaped, the pipe 6 can be smoothly moved upwards without touching the ring-shaped member 5, and also the position of the air vent 25 of the pipe 6 can be automatically determined by the engagement of the pawl 26 with the engageable hole 27** so that good ventilation can be achieved.

Figure 9:
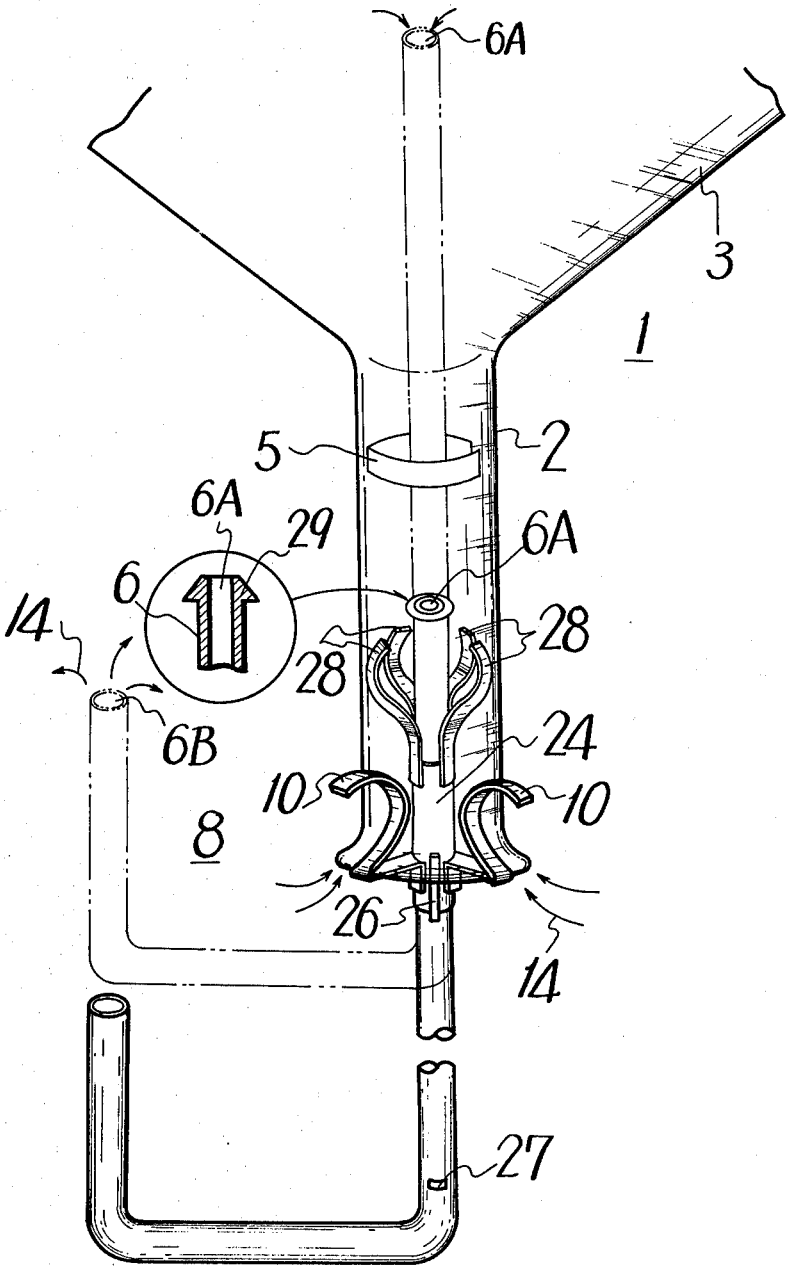

FIG. 9 shows a modified embodiment of the ventilator 8 of FIG. 8. Other resilient members 28 are provided to the housing 24 at its portion inside the neck 2 for resiliently urging the neck inner wall to positively support the housing 24 in the neck 2. Further, a tapering collar 29 is provided at the opening 6A of the pipe 6 in the tube 1. This collar 29 is arranged to prevent the ring-shaped member 5 from being pushed up and also serves as a stopper when the ventilator 8 is unloaded from the tube 1.

According to this invention as mentioned above, with the process in the frit-sealing furnace, the ventilator 8 formed of the simple pipe 6 is disposed in the cathode ray tube 1 so that ventilation inside the cathode ray tube 1, particularly near its phosphor surface, can be satisfactorily achieved. Further, at the same time during the frit-sealing process of the panel portion and funnel portion, the baking of the phosphor surface, or the baking and decomposition of polyvinyl alcohol of the phosphor coating and the acrylic resin layer, are also accomplished. Particularly, it is suitable for use for baking a color phosphor surface which has been recently formed by using phosphor of large grain size and improves the brightness. This invention is also applicable to prior art baking of color phosphor surfaces, or black and white phosphor surfaces.

While the principles of the invention have been described above in connection with specific embodiments, and particular modification thereof, it is to be clearly understood that this description is made only by way of example and not as a limitation on the scope of this invention.

We claim as our invention:

1. Apparatus for ventilating a cathode ray tube having a panel portion, and a funnel portion having a tubular neck portion with an open end comprising, a hollow pipe extending into the open end of said tubular neck portion and its inner end terminating prior to said panel portion, the outer end of said pipe formed into a conical shaped flange so that the inner diameter increases with distance from the end of said tubular neck portion so as to form an opening at its outer end larger than the inner opening of the portion of said pipe within said tubular neck portion, and spring holder means attached to said hollow pipe and engageable with said tubular neck portion so as to support said hollow pipe within said cathode ray tube and to space said conical shaped flange away from said tubular neck portion so that air can pass up through said hollow pipe and out of said cathode ray tube between said tubular neck portion and the outer surface of said hollow pipe by natural convection.

2. Apparatus according to claim 1 wherein the passage of said inner end of said hollow pipe being reduced in cross-section to form a nozzle.

3. Apparatus according to claim 1 including a centering means attached to said pipe near its inner end and engageable with the inner surface of said tubular neck portion.

* * * * *